US006056498A

United States Patent [19]

Velinsky et al.

[11] Patent Number: 6,056,498

[45] Date of Patent: May 2, 2000

[54] APPARATUS FOR RETRIEVING CONICAL ROADWAY WARNING MARKERS

[75] Inventors: Steven A. Velinsky; Cornelius J. Belltawn; Wilderich A. White, all of Davis, Calif.

[73] Assignee: The Regents of the University of California, Oakland, Calif.

[21] Appl. No.: 09/151,254

[22] Filed: Sep. 9, 1998

[51] Int. Cl.[7] ..... E01F 9/01

[52] U.S. Cl. ..... 414/555; 414/551; 414/501; 414/502

[58] Field of Search ..... 414/555, 551, 414/501, 502, 434

[56] References Cited

U.S. PATENT DOCUMENTS

| | | |
|---|---|---|
| 3,750,900 | 8/1973 | Piercey . |
| 4,219,141 | 8/1980 | Lovy . |
| 4,597,706 | 7/1986 | Michit . |
| 5,026,204 | 6/1991 | Kulp et al. . |
| 5,054,648 | 10/1991 | Luoma . |
| 5,213,464 | 5/1993 | Nicholson et al. . |
| 5,244,334 | 9/1993 | Akita et al. . |
| 5,525,021 | 6/1996 | Larguier . |

FOREIGN PATENT DOCUMENTS

| | | |
|---|---|---|
| 0 145 625 | 6/1985 | European Pat. Off. . |
| 0 421 198 A1 | 4/1991 | European Pat. Off. . |
| 0463447 | 6/1991 | European Pat. Off. . |
| 2 175 336 | 11/1986 | United Kingdom . |

*Primary Examiner*—Steven A. Bratlie
*Attorney, Agent, or Firm*—John P. O'Banion

[57] ABSTRACT

An apparatus which automatically retrieves conical highway warning markers from the roadway and transports the cones to a support vehicle for storage. The apparatus, which is attached to a vehicle, comprises a clamping plate disposed at the end of a lifting arm, which clamps the base of the traffic cone onto a platform. The lifting arm then rotates to raise the cone to a position for stowage. The raised cone can then be manually removed from the lifting arm for stowage or, alternatively, dropped onto a conveyor system which transports the traffic cone to a storage area within the vehicle.

13 Claims, 6 Drawing Sheets

APPARATUS FOR RETRIEVING CONICAL ROADWAY WARNING MARKERS

STATEMENT REGARDING FEDERALLY SPONSORED RESEARCH OR DEVELOPMENT

This invention was made with Government support under Grant No. RTA65X938, awarded by the California Department of Transportation, New Technology and Research. The Government has certain rights in this invention.

CROSS-REFERENCE TO RELATED APPLICATIONS

Not Applicable

REFERENCE TO A MICROFICHE APPENDIX

Not Applicable

BACKGROUND OF THE INVENTION

1. Field of the Invention

This invention pertains generally to retrieval of roadway hazard warning markers, and more particularly to an apparatus for the automatic retrieval of safety cones from the roadway.

2. Description of the Background Art

Many highway construction, maintenance and repair activities require physical separation between a designated work area and lanes that remain open to traffic. Busy highways, fast moving traffic and debris traveling at high speeds create an extremely hazardous environment that presents a danger to work crews. High visibility safety markers are commonly used to close a number of lanes and create a safety zone where crew workers can perform maintenance, repair, and construction on the highway. Although a variety of safety markers exist, traffic cones are the most common because they can be stored compactly, are easily transported, and require no assembly. In addition, traffic cones are widely available in different sizes and weights to satisfy various traffic and road conditions.

Manual deployment of traffic cones is a method used worldwide, although several automated cone placement and retrieval devices have been developed to assist with this tedious procedure.

One such device is capable of retrieving and storing approximately between 1500 and 2000 traffic cones, and can be operated by a single driver up to speeds above 35 mph. This device picks up standing cones by first capturing them with two revolving paddle wheels. The traffic cones are then moved upward and rearward by a conveyor. The cone is then placed in a depositing area where cones are stacked vertically. Once the cones are stacked to a predetermined height, the cone stack is released on sloped rollers and placed on the rear end of the vehicle. The cone stacks could also be moved laterally on rollers to maximize the vehicle's storage capacity.

The problem that is apparent with this device is its impracticality due to the bulky nature of the retrieving mechanisms and the large frame of the vehicle. In addition, cones that are knocked over present a difficult problem for this machine since it has no means of manipulating the cones on the road surface.

Another known device provides for the automated retrieval of traffic cones has an operating speed of approximately 11 mph and a storage capacity of 240 traffic cones. During retrieval procedures, the driver must manipulate the cone into one of two positions using short vertical bars that can orient the cones in either a base first or a cone tip first configuration. If manipulated into a base first configuration, the cone can be picked up as if it were an upright cone. However, if the cone is placed in a cone tip first position, a horizontal bar is lowered to contact the base of the cone and flip it so that the cone falls into the base first configuration. With the vehicle moving forward, a prong enters through the open bottom of the cone and lifts the cone upwards. Once a cone has been picked up, a chain link conveyor is used to lift the cone upwards to a chute that leads to the storage area. The cone is stripped from the prong by a simple bar mechanism and it falls through the chute. The falling cone is stacked vertically in one of ten vertical cylinders that form a circular ring.

The problem presented by this device is it can only retrieve custom sized cones and not a wide variety of cone designs. In addition, the large size of the device makes it difficult to adapt to various truck frames. Furthermore, the device cannot be used to retrieve cones in a reverse direction which is generally the preferred direction for retrieval.

A third such known device that collects cones consists of a rotating wheel mechanism operating off of the bed of a truck. The rotating wheel mechanism includes two conical disks that are spaced to wedge a traffic cone between them and is deployed to the side of a truck for retrieval of cones. For retrieval, the cones are simply run over by the rotating wheel. The cone becomes wedged between the two disks and is carried upwards as the large wheel rotates. Another bar is used to free the cone from the wheel and to allow the operator to manually store the cone.

This device exhibits difficulties under certain situations. For example, a significant amount of road space is required for the rotating wheel to deploy and retract. It is also necessary for deployment and retraction to be performed at the work site because when the wheel is deployed, the truck becomes too cumbersome to maneuver in traffic. The deployment and retraction of the wheel also requires manual assistance from personnel located on the road. This exposure to traffic is extremely hazardous to the crew, and since the operator of the device must remain seated within the truck bed, there exists a high risk due to the moving traffic, the potentially hazardous mechanisms of the rotating wheel and loose debris on the road. Also, the operator who performs the tasks within the truck bed is subject to lifting and repetitive motion-type injuries.

Thus, there is a need for an automated traffic cone retriever that is capable of retrieving cones when the cones are in any position on the roadway, that is space efficient and adaptable to a variety of trucks, and that eliminates the need of a worker within the bed area of the truck. The present invention satisfies these needs, as well as others, and generally overcomes the deficiencies found in the background art.

BRIEF SUMMARY OF THE INVENTION

The present invention generally comprises an apparatus for the automatic retrieval of traffic warning cones from the surface of a roadway. The invention can be mounted adjacent the side of a support vehicle to provide for the automatic grasping and lifting of a traffic cone from the roadway. Cones that are retrieved by the apparatus can be grabbed by an operator and manually placed in a storage area in the vehicle or, if desired, the apparatus can be combined with a conveyor system for automatic stacking and storage of retrieved cones.

By way of example, and not of limitation, the invention comprises a lifting arm, a first actuating means for moving the lifting arm between a raised position and a lowered position, a platform coupled to an end of the lifting arm, a clamping plate pivotally coupled to the platform, and a second actuating means for moving the clamping plate between a closed position and an open position. At least one sensor is provided to activate the clamping plate when the lifting arm is lowered and the base of a cone is in position for retrieval. When that occurs, the base of the cone is clamped between the platform and the clamping plate, and the lifting arm is raised for removal of the cone. To assist with cone retrieval, the invention can be combined with an orientation mechanism that knocks over vertical standing cones and orients their base toward the platform for retrieval. Cones that are already knocked over with their tip oriented toward the platform can be flipped up to a standing position and then knocked over to the desired base first position.

At the onset of the retrieval process, the lifting arm is lowered and the clamping plate is opened away from the platform. This relationship is maintained as the platform draws near the base of the cone. When the platform abuts the base of the cone, the second actuating means moves the clamping plate to a closed position thereby firmly grasping the base of the cone onto the platform. The lifting arm then moves to its raised position, lifting the traffic cone to a generally vertical position above the apparatus. At this point the clamping plate releases the base of the cone. An operator can then manually grasp the cone and place it into a storage area. Alternatively, a conveyor system or the like can be included to transport the cone to a storage area in the support vehicle.

An object of the invention is to provide an apparatus that automatically retrieves conical highway warning markers from a road surface.

Another object of the invention is to provide an apparatus that automatically transports retrieved conical highway markers to a storage area.

Another object of the invention is to provide an automatic cone retrieval apparatus that minimizes space requirements on the support vehicle.

Another object of the invention is to provide an automatic cone retrieval apparatus that is operable with the support vehicle moving in either the forward or reverse direction.

Still another object of the invention is to provide an automatic cone retrieval apparatus that is adaptable to a wide variety of support vehicles.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 6. It will be appreciated that the apparatus may vary as to configuration and as to details of the parts without departing from the basic concepts as disclosed herein.

Figure 1:
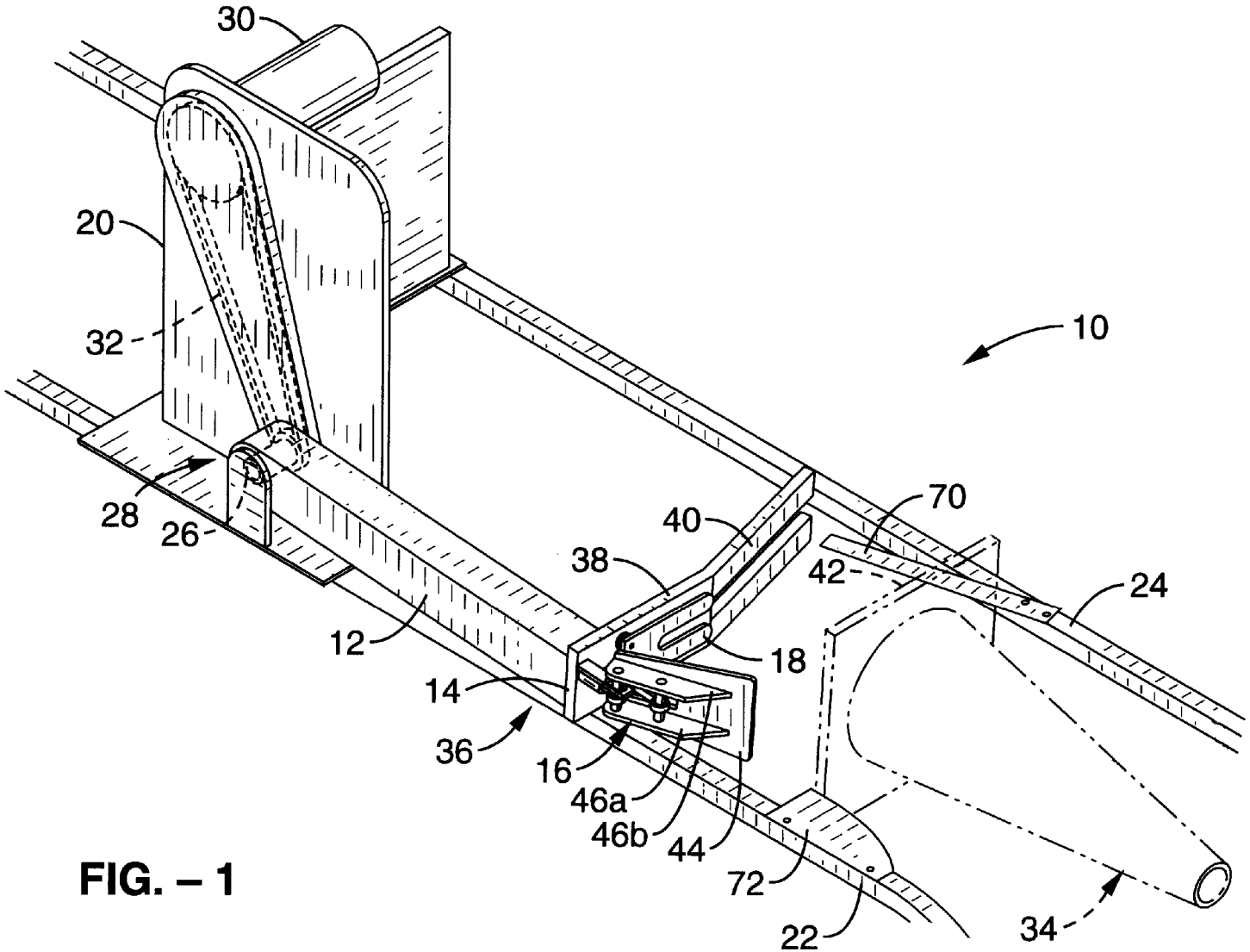
FIG. 1 is a perspective view of a highway safety cone retrieval apparatus in accordance with the invention positioned adjacent to a traffic cone depicted in phantom.
Figure 2:
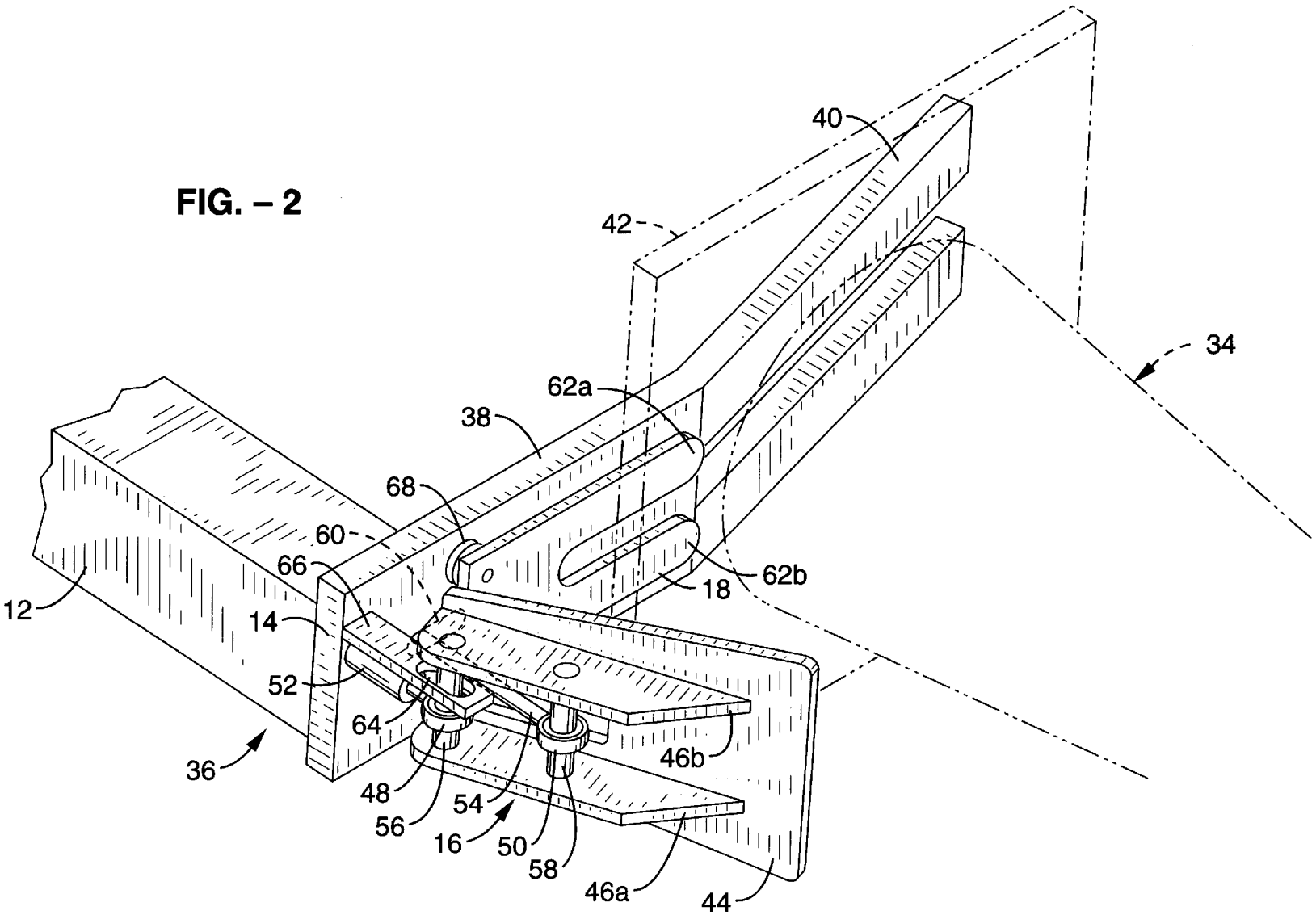
FIG. 2 is a detailed fragmentary view of the apparatus shown in FIG. 1.

Referring first to FIG. 1 and FIG. 2, an apparatus 10 for retrieving conical roadway warning markers in accordance with the present invention is generally shown. Apparatus 10 comprises a lifting arm 12, a base platform 14, a clamp assembly 16, and a sensor plate 18. Also shown are a support frame 20 for supporting and attaching the foregoing to a vehicle, an outer rear funnel bar 22, and an inner rear funnel bar 24 used to guide a cone toward the apparatus.

Figure 3:
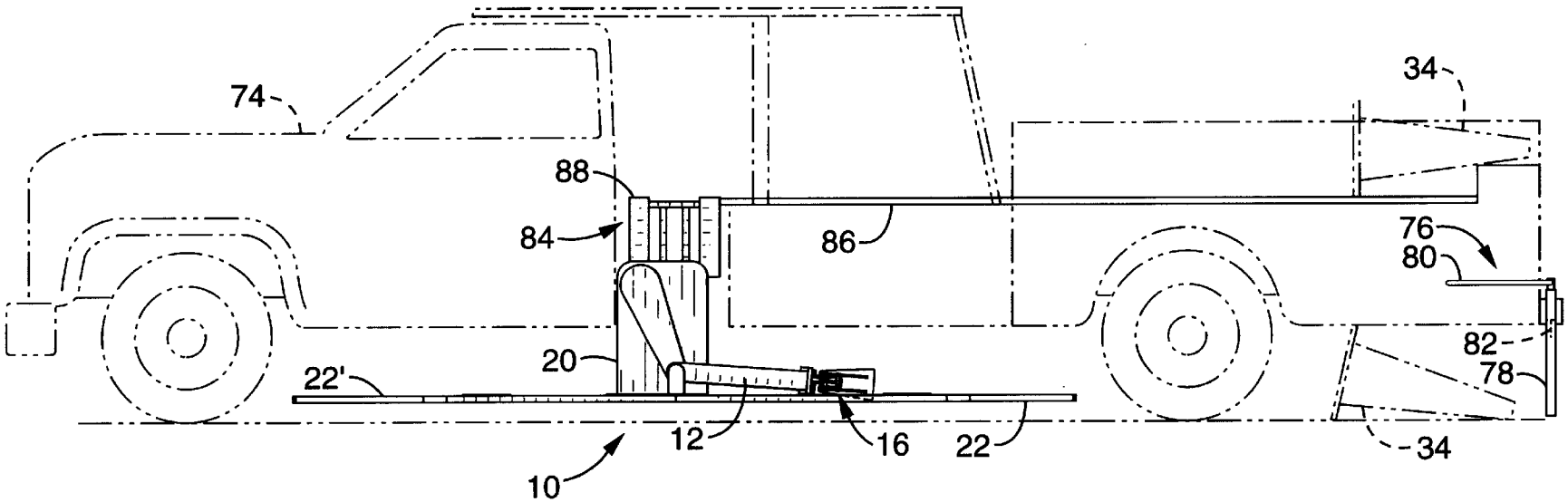
FIG. 3 is an elevation view showing the apparatus of FIG. 1 attached to a support vehicle depicted in phantom and showing the lifting arm in a lowered position.
Figure 4:
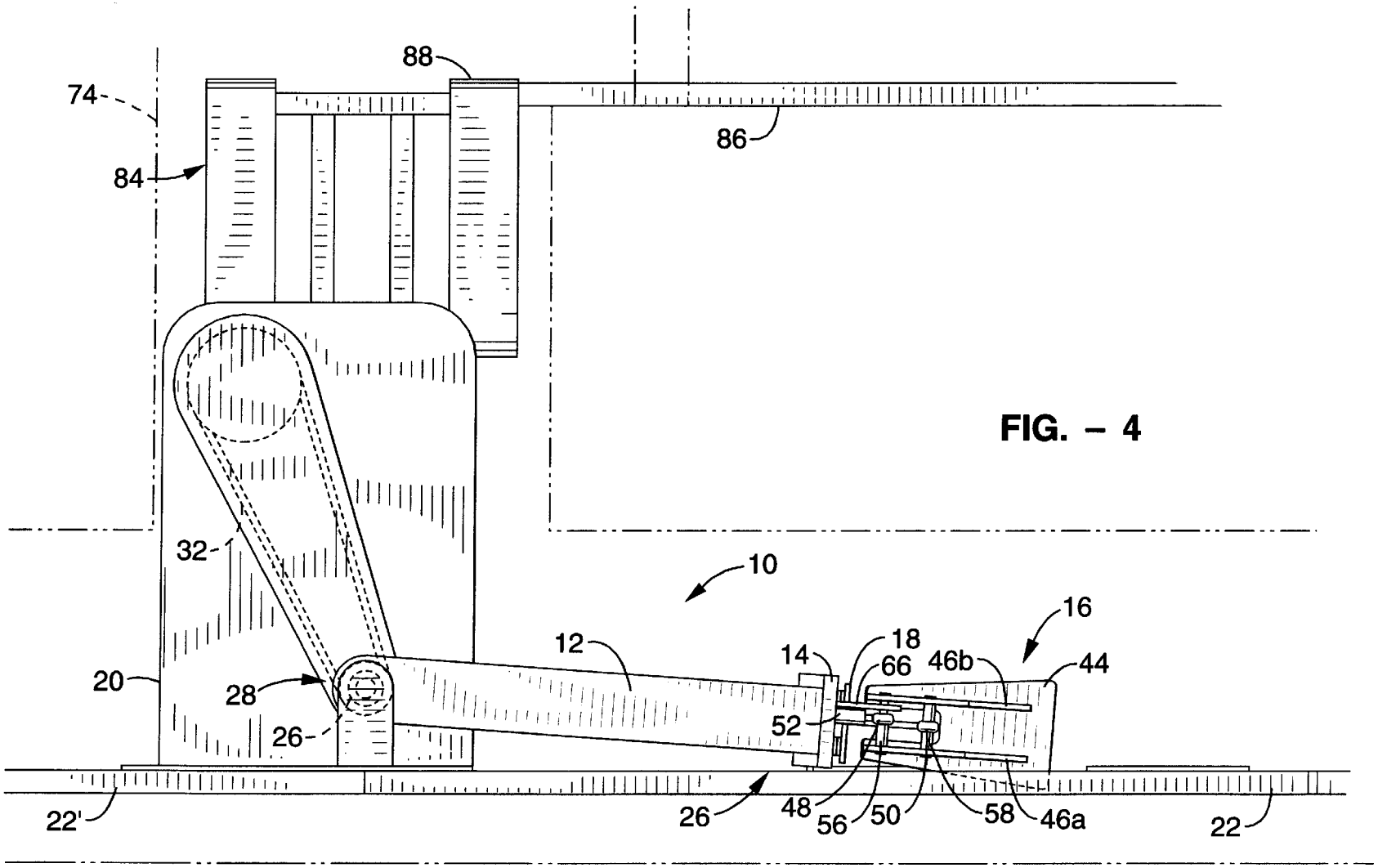
FIG. 4 is a detailed fragmentary view of the cone retrieval apparatus of the present invention as shown in FIG. 3.
Figure 5:
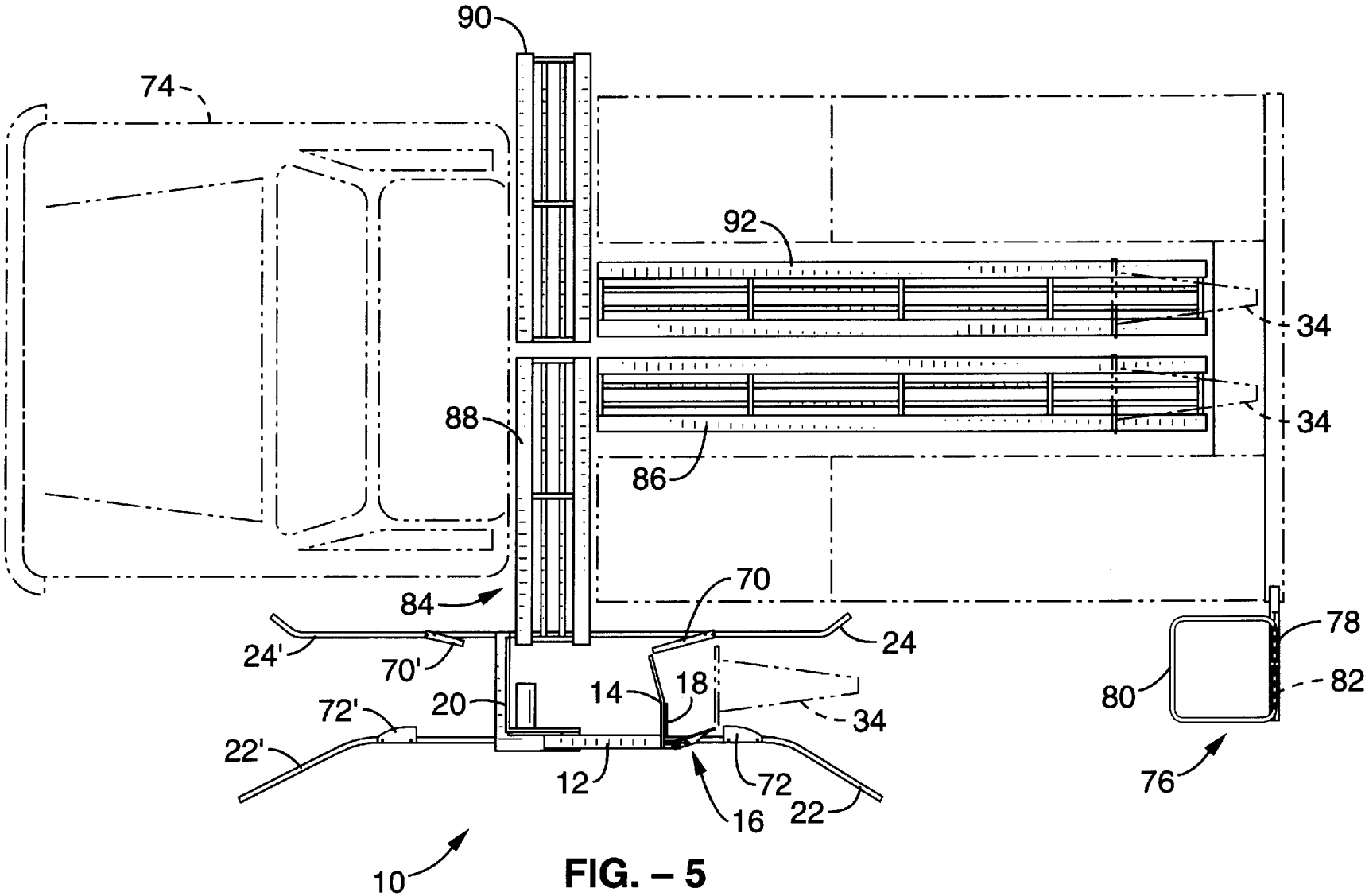
FIG. 5 is a plan view of the assembly shown in FIG. 3.
Figure 6:
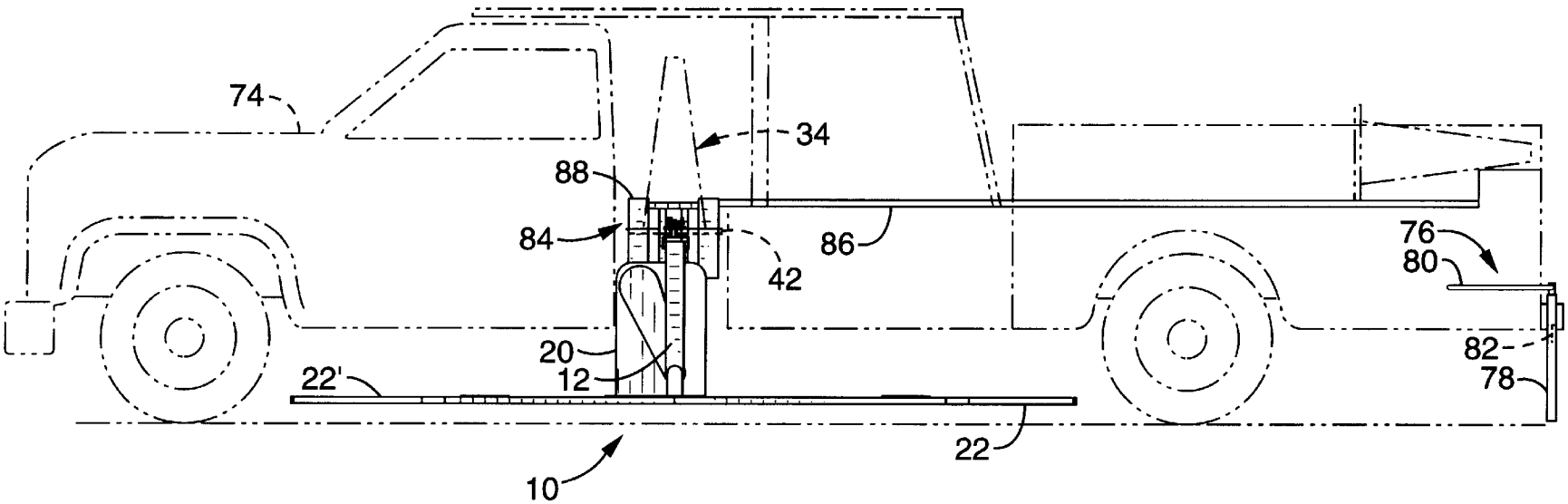
FIG. 6 is an elevation view of the assembly shown in FIG. 3 with the lifting arm shown in a raised position.

Lifting arm 12 pivots about a roller bushing 26 or the like at its proximal end 28. Rotational motion is imparted to lifting arm 12 though the use of a motor or other actuator 30 coupled, for example, to lifting arm 12 through a gear and chain drive 32 or other conventional drive mechanism. Referring also to FIG. 3 and FIG. 6, this allows for movement of lifting arm 12 between a lowered position wherein lifting arm 12 is just below a generally horizontal position as shown in FIG. 3, to a raised position wherein lifting arm 12 is disposed in a generally vertical orientation as shown in FIG. 6.

It will be appreciated that lifting arm 12 should be fabricated from materials capable of withstanding the torsional and bending loads generated when lifting and transporting a highway safety traffic cone 34 from the lowered position to the raised position. Furthermore, lifting arm 12 should also be able to withstand other expected loads such as impact with a cone at high speeds.

Platform 14 is attached to the distal end 36 of lifting arm 12, and has a first section 38 and an optional angularly offset second section 40. First section 38 of platform 14 allows for the stable abutment of the base 42 of traffic cone 34 thereon. Second section 40 can be used to provide a ramp for removal of the cone when lifting arm 12 is in the raised position.

Referring more particularly to FIG. 2, it can be seen that clamp assembly 16 generally comprises a clamping plate 44, a pair of support flanges 46*a*, 46*b*, an outer ball joint 48, an inner ball joint 50, a support arm 52, an actuator arm 54, an outer connecting rod 56 and an inner connecting rod 58. Clamp assembly 16 is disposed adjacent first section 38 of platform 14 such that clamping plate 44 is pivotable between an open position and a closed position relative to platform 14.

Clamping plate 44 is shown in its open position in FIG. 2 and is actuated to a closed position, wherein clamping plate 44 is adjacent and substantially parallel to first section 38 of platform 14. In the closed position, base 42 of traffic cone 34 can be securely held between clamping plate 44 and first section 38 of platform 14 with sensor 18 disposed therebetween. Support flanges 46*a*, 46*b* span clamping plate 44 longitudinally to provide structural support and a means for attaching outer and inner connecting rods 56, 58.

Outer and inner connecting rods 56, 58 are positioned generally parallel to each other and are inserted at each end onto support flanges 46*a*, 46*b*, thereby providing an attachment means to support arm 52 and actuator arm 54. Support arm 52 is pivotally attached at one end to outer connecting rod 56 by outer ball joint 48 and fixedly mounted onto platform 14 its other end. Actuator arm 54 is similarly attached at one end to inner connecting rod 58 by inner ball joint 50. Actuator arm 54 is located substantially within the hollow rectangular cross-section of lifting arm 12 and extends through a longitudinal opening 60 in platform 14. Actuator arm 54 is preferably a conventional hydraulic piston or the like which is connected to hydraulic lines (not shown) for activation.

The longitudinal motion of actuator arm 54 regulates motion of clamping plate 44 between the open position and the closed position. As actuator arm 54 retracts, clamping plate 44 moves to the closed position and, conversely, as actuator arm 54 extends, clamping plate 44 moves to the open position. Because inner connecting rod 58 travels through an arc during the opening and closing of clamping plate 44, actuator arm 54 moves laterally within longitudinal opening 60 during the process. By using two ball joints instead of simple hinges, clamping plate 44 is allowed to rotate several degrees about an axis defined by a line through the center of the two ball joints. This design also permits the clamping load to be distributed relatively uniformly along clamping plate 44. This distribution of the clamping load helps to prevent the cone from rotating about a single point of contact that would occur when lifting the cone with a simply hinged clamp and an uneven cone base. Guide slot 64 restricts clamping plate 44 from rotating about the ball joints when in the open position but allows rotation when clamped. Guide slot 64 is disposed in a guide plate 66 that protrudes perpendicularly from first section 38 of platform 14.

It will be appreciated that clamping plate 44 can have other structural configurations so long as a surface is provided to engage the base of the cone for purpose of holding the base of the cone against platform 14. It will also be appreciated that an alternative to using ball joints would be to use flexible rubber bushings that allow for rotation and compliant movement. The requirement of clamp assembly 16 is to be able to move between an open position where there is no clamping action and a closed position where the base of a cone is held securely.

As traffic cone 34 approaches platform 14, base 42 of traffic cone 34 pushes against sensor plate 18. Note that sensor plate 18 is pivotally coupled to first section 38 of platform 14 and is normally biased away from first section 18 by a pair of spaced-part springs 68 (only one spring is shown). When sensor plate is compressed against first section 38 of platform 14, a conventional switch (not shown) is activated to provide a control signal for operation of actuator rod 54 and lifting arm 12. Clamping plate 44 then closes and, when the base of the cone is firmly grasped, lifting arm 12 moves from the lowered position to the raised position. Note that sensor plate 18 includes a pair of spaced-apart prongs 62*a*, 62*b* with a gap therebetween. This configuration is preferred where the base of cone has protruding pads (not shown) that could cause the base of the cone not to seat against sensor plate 18. In this way, the pads on the base of the cone would fit within the gap, thus providing good surface contact between the base and the sensor plate.

Referring again to FIG. 1, if desired a sensor arm 70 can be included to operate a second switch in series with the first switch to ensure that the base of the cone is in the proper position before activation of clamping plate 44 and lifting arm 12. It will be appreciated that other types of sensors could be employed, including photosensors and the like. Note also that, in the embodiment shown, clamping plate 44 extends into the travel path of cone 34. A guide plate 72 can also be included for lateral alignment of the base of the cone so that it clears clamping plate 44. It will be appreciated that guide plate 72 would be unnecessary if clamping plate 44 opens wider in relation to platform 14 and is not in the path of travel of cone 34.

Referring also to FIG. 3 through FIG. 6, apparatus 10 is shown in context with a truck or other support vehicle 74 to which support frame 20 is attached. The apparatus is preferably used in conjunction with a primary funnel assembly 76 that knocks over vertical standing cones and orients their base toward the apparatus. Primary funnel assembly 76 is modular and preferably mounted at the rear corner of support vehicle 74 for retrieving cones from a rearward direction or at the front corner of the support vehicle for retrieving cones from a forward direction. Primary funnel assembly 76 comprises a vertically extending frame 78, a tipping bar 80 and a motor (not shown). Frame 78 holds a swinging door 82 that either swings freely or becomes rigid by action of an operator controlled solenoid (not shown). Activation of the motor allows primary funnel assembly 76 to be stowed within the width of support vehicle 74 or extended outwardly as shown.

When swinging door 82 is in the locked position, tipping bar 80 and swinging door 82 work together to rotate a cone 180° if the cone passes tip first through the primary funnel. The door catches the top edge of the cone base, thus causing the cone to stand up, and tipping bar 80 then flips the cone from the standing position to the desired base first orientation. For already standing cones, the horizontal framework between the vertically extending legs of frame 78 and swinging door 82 tip the cone over. Cones laying on the road in orientations other than tip first pass beneath the unlocked swinging door 82 and are oriented base first as they pass through frame 78.

Outer and inner rear funnel bars 22, 24 serve to guide traffic cone 34 toward platform 14 when support vehicle 74 travels in a reverse direction. Apparatus 10 can also be used with outer and inner forward funnel bars 22', 24' (and optional sensor 70' and guide 72'), which guide traffic cone 34 toward platform 14 when support vehicle 74 travels in the forward direction. In this instance, lifting arm 12 is oriented so that platform 14 is forwardly disposed. Once a cone is retrieved, it can be manually grabbed by an operator and placed into a storage bin. Alternatively, an optional lateral conveyor system 84, operating transversely on support vehicle 74, could be used to transport traffic cone 34 from lifting arm 12 to a stowage stack 86.

It will be appreciated that, while only a left side cone retrieval mechanism is shown, the mechanism could be alternatively placed on the right side of the vehicle or cone retrieval mechanisms could be placed on both sides of the vehicle. It will also be appreciated that various other conveyor configurations could be employed. In an embodiment of a cone retrieval system for both sides of a vehicle, lateral conveyor system 84 comprises a left conveyor assembly 88, a right conveyor assembly 90, a motor (not shown) that runs conveyor assemblies 88, 90 and a sensing system (not shown) to signal when a traffic cone has been retrieved. Left conveyor assembly 88 transports traffic cone 34 towards the center of support vehicle 74 where a cone stowage system (not shown) automatically moves traffic cone 34 onto left stowage rack 86. Similarly, right conveyor assembly 90 would transport cones toward the center of the vehicle for ultimate storage in right stowage rack 92.

A control unit (not shown) is responsible for integrating all of the described systems to efficiently manipulate traffic cones during cone retrieval procedures. By processing the signals produced by various sensors and switches, the control unit can locate the position of the cone and prepare the crucial interfaces between these systems. The control unit, which can be microprocessor-based or employ discrete components, used to implement a series of logical procedures that can activate particular sequences of systems. The control unit allows the driver to input the characteristics of the operation so that the proper components of apparatus 10 can be activated, deployed or retracted. This control unit is preferably mounted both inside and outside support vehicle 74 for easy access by the driver of support vehicle 74 during deployment or retrieval procedures or for maintenance testing of apparatus 10 where the performance of its components can be evaluated from a more local site. The control unit would also preferably be capable of initiating a complete system shutdown in the event of an emergency.

Accordingly, it will be seen that this invention allows for an efficient and reliable automated retrieval and stowage of traffic cones from a roadway onto a support vehicle. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An apparatus for retrieving a warning marker from a roadway surface, comprising:

(a) a lifting arm having a proximal end and a distal end, said lifting arm moveable between a lowered position and a raised position;

(b) a platform coupled to said distal end of said lifting arm;

(c) a clamping plate pivotally coupled to said platform and moveable between an open position and a closed position in relation to said platform; and (d) a sensor, said lifting arm and said clamping plate operatively responsive to said sensor wherein said lifting arm moves to said raised position when said clamping plate moves to said closed position.

2. An apparatus as recited in claim 1, further comprising:

(a) first actuating means for moving said lifting arm between said lowered position and said raised position; and (b) second actuating means for moving said clamping plate between said closed position and said open position.

3. An apparatus as recited in claim 1, wherein when a base portion of a roadway warning marker contacts said sensor said clamping plate moves to said closed position and clamps said base portion between said clamping plate and said platform and said lifting arm moves to said raised position.

4. An apparatus as recited in claim 1, wherein said sensor comprises a plate pivotally coupled to said platform and biased away from said platform.

5. An apparatus as recited in claim 1, further comprising a support frame coupled to said proximal end of said lifting arm.

6. An apparatus for retrieving a warning marker from a roadway surface, comprising:

(a) a lifting arm having a proximal end and a distal end, said lifting arm moveable between a first lowered position and a second raised position;

(b) a platform coupled to said distal end of said lifting arm;

(c) a clamp assembly coupled to said platform, said clamp assembly including a clamping plate moveable between a first open position and a second closed position in relation to said platform; and (e) a sensor plate coupled to said platform, said lifting arm and said clamp assembly operatively responsive to said sensor plate coming into contact with a base portion of a roadway warning marker wherein said lifting arm moves to said raised position when said clamping plate moves to said closed position.

7. An apparatus as recited in claim 6, further comprising:

(a) first actuating means for moving said lifting arm between said lowered position and said raised position; and (b) second actuating means for moving said clamping plate between said closed position and said open position.

8. An apparatus as recited in claim 7, further comprising:

(a) a first ball joint coupled to said clamping plate;

(b) a support arm coupled between said platform and said first ball joint; and (c) a second ball joint coupled to said clamping plate, said second actuating means coupled to said second ball joint.

9. An apparatus as recited in claim 6, further comprising a support frame coupled to said proximal end of said lifting arm.

10. An apparatus for retrieving a warning marker from a roadway surface, comprising:

(a) a lifting arm having a proximal end and a distal end;

(b) means for supporting said lifting arm from a vehicle, wherein said lifting arm moves between a lowered position and a raised position; and (c) clamping means coupled to said lifting arm for clamping and releasing the base of a roadway warning marker, wherein said lifting arm moves to said raised position when said clamping means engages said marker base.

11. An apparatus as recited in claim 10, further comprising:

(a) first actuating means, coupled to said lifting arm, for moving said lifting arm between said lowered position and said raised position; and (b) second actuating means, coupled to said clamping means, for controlling clamping and releasing motion of said clamping means.

12. An apparatus as recited in claim 11, wherein clamping means comprises:

(a) a clamping plate; and (b) a platform, wherein said clamping plate is pivotally coupled to said platform and moveable between an open position and a closed position in relation to said platform.

13. An apparatus as recited in claim 12, further comprising:

(a) a first ball joint coupled to said clamping plate;

(b) a support arm coupled between said platform and first ball joint; and (c) a second ball joint coupled to said clamping plate, said second actuating means coupled to said second ball joint.

* * * * *